US007048568B2

(12) United States Patent
Fisher et al.

(10) Patent No.: US 7,048,568 B2
(45) Date of Patent: May 23, 2006

(54) HOUSING ASSEMBLY AND A PAIR OF ELECTRIC CONNECTORS USING IT

(75) Inventors: Andrew Fisher, Ortonville, MI (US); Tsuyoshi Osada, Novi, MI (US); Ping Chen, West Bloomfield, MI (US)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/101,745

(22) Filed: Apr. 7, 2005

(65) Prior Publication Data

US 2005/0245122 A1 Nov. 3, 2005

(30) Foreign Application Priority Data

Apr. 28, 2004 (JP) ..... 2004-134917

(51) Int. Cl.
*H01R 13/627* (2006.01)

(52) U.S. Cl. ..... 439/352; 439/489

(58) Field of Classification Search ..... 439/352, 439/489, 488, 350, 354, 355, 356, 357, 358
See application file for complete search history.

(56) References Cited

U.S. PATENT DOCUMENTS

| | | | | |
|---|---|---|---|---|
| 4,634,204 A | | 1/1987 | Detter et al. | |
| 4,946,404 A | | 8/1990 | Takenouchi et al. | |
| 5,120,255 A | * | 6/1992 | Kouda et al. | 439/489 |
| 5,681,178 A | * | 10/1997 | Kunkle et al. | 439/352 |
| 5,707,248 A | * | 1/1998 | Matsumura | 439/489 |
| 6,468,105 B1 | * | 10/2002 | Noguchi et al. | 439/489 |
| 6,786,754 B1 | * | 9/2004 | Yamaoka et al. | 439/352 |

FOREIGN PATENT DOCUMENTS

| | | |
|---|---|---|
| EP | 1 113 537 | 7/2001 |
| JP | 03-285280 | 12/1991 |
| JP | 09-017505 | 1/1997 |

* cited by examiner

*Primary Examiner*—Tulsidas C. Patel
*Assistant Examiner*—Vladimir Imas
(74) *Attorney, Agent, or Firm*—W. F. Fasse; W. G. Fasse

(57) ABSTRACT

A housing assembly for a pair of electric connectors includes a first housing with a lock arm to lock the first housing inserted into a second housing, and a reinforcing member held by the first housing. The reinforcing member can be pushed into the first housing only when the first housing and the second housing are completely properly fitted together. The coupling strength between the housings is enhanced by the coupling strength of the reinforcing member, and the operator can easily and properly judge the proper fitting of the housings on the basis that the reinforcing member can be pushed in. As the first housing holds the reinforcing member, the fitting work can be done smoothly and reliably. Both housings can be made slimmer. This assembly allows a single-action fitting wherein the first housing can be fitted in the second housing by pushing only the reinforcing member.

16 Claims, 15 Drawing Sheets

HOUSING ASSEMBLY AND A PAIR OF ELECTRIC CONNECTORS USING IT

BACKGROUND OF THE INVENTION

1. Field of the Invention

The present invention belongs to the field of electric connectors, and relates to a technique for confirming the fitting between a pair of electric connectors when they are fitted together and enhancing their coupling strength.

2. Related Art

Japanese Unexamined Patent Publication Heisei 9-17505 discloses a connector assembly with a fitting guaranteeing device wherein a fitting guaranteeing device comprising a fixing beam and a flexible beam is temporarily fitted on an outside surface of one of a pair of connector housings that can be fitted together in such a way that said fitting guaranteeing device will slide to a regular fitting position only when said pair of connector housings fit together, when said fitting guaranteeing device slides to said regular fitting position, said fixing beam will shift exposed on said outside surface, said flexible beam will be flexed inward to fit with a fitting lock means of said pair of connector housings so as to prevent unlocking of said fitting lock means. With the use of this connector assembly with a fitting guaranteeing device, firstly, unlocking of the fitting lock can be prevented reliably, and the operator can easily and properly judge, through senses of vision and touch, whether the connector housings are fitted together completely, mainly on the basis of the position of the fixing beam, and secondly, the operation of fitting the connectors together can be done relatively easily and reliably by temporarily fitting the fitting guaranteeing device on the connector housing.

SUMMARY OF THE INVENTION

In the case of the connector assembly of Japanese Unexamined Patent Publication Heisei 9-17505, when both the connector housings are fitted together completely, the end part of the flexible beam will be set on the lower side of the end part of the plug housing, and this in turn will double-lock the lock arm. Accordingly, the coupling strength between the pair of the connector housings depends entirely on the strength of the lock arm alone. However, it has been keenly desired hitherto to enhance the coupling strength of the pair of connector housings of this kind of connector assembly. Moreover, as the flexible beam is flexed inward so that its end part will be set on the lower side of the end part of the plug housing, it is necessary to provide a space inside the plug housing so as to tolerate the flexure of the flexible beam. This, in turn, makes the connectors thicker, preventing compactification of the plug housing.

The present invention was made in view of these points, and its object is to provide a reinforcing member apart from a lock arm, said reinforcing member is to be held by a first housing, said reinforcing member can be pushed into the first housing only when the first housing and the second housing are fitted together, to enhance the coupling strength of both the housings based on the lock arm by adding the coupling strength based on the reinforcing member, to enable the operator to judge easily and reliably whether both housings are fitted together on the basis of that the reinforcing member can be pushed in, to ensure smooth and reliable insertion work by holding the reinforcing member by the first housing, and to slim both housings. Another object of the present invention is to accomplish a single-action fitting wherein the first housing is fitted into the second housing by only pushing the reinforcing member rearward.

To accomplish the above-mentioned objects, the housing assembly of the present invention is a housing assembly comprising a first housing and a second housing being insulating housings of a pair of electric connectors to be coupled or uncoupled, and a reinforcing member for enhancing the coupling strength of these housings, wherein when a depth direction, a width direction and a height direction all being perpendicular to each other are assumed, the second housing is provided with a cavity, which opens on the front side in the depth direction and into which the first housing is to be fitted, the first housing is provided with a lock arm, which extends from the rear side to the front side in the depth direction and can be flexed to the lower side and is provided with a lock pawl on the higher side thereof, of walls facing the cavity in the second housing, a wall on the higher side in relation to the cavity is provided with a fitting part, which fits with the lock pawl when the lock arm shifts rearward and only after the lock pawl gets over the fitting part through flexure of the lock arm, the first housing is provided with a receiving chamber, which penetrates into the first housing in the depth direction, a reinforcing member having a body is inserted into this receiving chamber in such a way that the reinforcing member can be slid between a front side position wherein the body is on the front side of the first housing and a rear side position being on the rear side of the front side position, inside the receiving chamber of the first housing, the first protruding parts are located to protrude to both sides in the width direction, the first protruding parts are fixed on the first housing, inside the cavity of the second housing, the second protruding parts are located to protrude to both sides in the width direction, the second protruding parts are fixed on the second housing, the reinforcing member is provided with a pair of flexible fitting arms, which extend from the body rearward and are so provided in the width direction that they are substantially parallel to each other, each fitting arm is provided with a top-end-side concaved part, which concaves from the inner side toward the outer side in the width direction and is to fit with the first protruding part when the reinforcing member is at the front side position, and each fitting arm is provided with a root-end-side concaved part, which concaves from the inner side toward the outer side in the width direction on the front side of the top-end-side concaved part in the depth direction and which is to fit with the first protruding part and the second protruding part when the first housing fits in the cavity of the second housing and the reinforcing member is at the rear side position, and the housing assembly being so structured that when the reinforcing member is held at the front side position by fitting the top-end-side concaved parts and the first protruding parts together, then the first housing is inserted into the cavity of the second housing, and the reinforcing member or the first housing is pushed rearward toward the second housing, the flexed lock arm will interfere with or will be able to interfere with the reinforcing member to prevent the reinforcing member from sliding rearward into the first housing, and the fitting arms will be pushed by the second protruding parts to move to both sides in the width direction and in turn release the top-end-side concaved parts from the first protruding parts, and when the first housing is fitted in the cavity of the second housing, the lock arm will restore itself due to fitting between the lock pawl and the fitting part, allowing the reinforcing member to slide rearward into the first housing, and when the reinforcing member is pushed to the rear side position in relation to the first housing, the root-end-side concaved parts will fit with the first protruding parts and the second protruding parts.

When contacts are added so that both the first housing and the second housing are provided with contacts, they will become a pair of electric connectors, and when the first housing fits in the second housing, the respective contacts of the housings will contact each other. When the first housing is withdrawn out of the second housing, the contacts of both housings will be separated from each other.

When the reinforcing member is held at the front side position by fitting the top-end-side concaved parts with the first protruding parts, the first housing is inserted into the cavity of the second housing, and the reinforcing member or the first housing is pushed rearward toward the second housing, the lock arm will be pushed by the fitting part of the second housing to flex to the lower side, the flexed lock arm will interfere with or will be able to interfere with the reinforcing member and prevent the reinforcing member from sliding rearward into the first housing, and the fitting arms will run into the second protruding parts to move to both sides in the width direction and release the top-end-side concaved parts from the first protruding parts. When the first housing fits in the cavity of the second housing, the lock pawl will get over the fitting part of the second housing and after that the lock arm will restore itself and the lock pawl will fit with the fitting part, and as a result of this, the reinforcing member will be allowed to slide rearward into the first housing. Next, when the reinforcing member is pushed to the rear side position in relation to the first housing, the fitting arms will restore themselves due to their flexibility, and in turn, the root-end-side concaved parts will fit with the first protruding parts and the second protruding parts. As described above, the reinforcing member never slides from the front side position to the rear side position before the first housing is fitted in the second housing. Hence errors such as that the top-end-side concaved parts of the reinforcing member fit with the second protruding parts before the fitting of the housings and that root-end-side concaved parts fit with the first protruding parts or the second protruding parts before the fitting of the housings are prevented. Moreover, the fitting with a single action, wherein only the reinforcing member is pushed rearward to fit the first housing into the second housing, can be made. On the other hand, inversely when the reinforcing member is pulled to the front side position in relation to the first housing, and the lock arm is flexed to shift the lock pawl to the lower side, the fitting between the lock pawl and the fitting part will be undone, and in turn, the first housing can be withdrawn out of the second housing.

In that case of fitting, as the root-end-side concaved parts of the reinforcing member fit with the first protruding parts and the second protruding parts, the coupling strength due to this reinforcing member is added to the coupling strength due to the fitting between the lock arm and the fitting part, hence the coupling strength between the first housing and the second housing is enhanced. Moreover, if the first housing is not fitted in the cavity of the second housing, the flexed lock arm will interfere with or will be able to interfere with the reinforcing member to prevent the reinforcing member from sliding rearward into the first housing, thus it will not be possible to push the reinforcing member rearward, and on the basis of this, the operator can easily and properly judge that the first housing is not fitted in the second housing, thus defective fitting can be prevented. Moreover, at the time of starting to insert the first housing into the cavity of the second housing, as the reinforcing member is held in the first housing by the fitting of the top-end-side concaved parts and the first protruding parts, the reinforcing member is prevented from dropping out of the housing assembly, and the fitting work can be done smoothly and reliably. Moreover, as the fitting arms of the reinforcing member flex in the width direction, the first housing and the second housing can be slimmed more in the height direction in comparison with the conventional connector housings, which are provided with a flexible beam that flexes in the height direction.

As the housing assembly of the present invention is so structured that the housing assembly is provided with a reinforcing member apart from a lock arm, the reinforcing member is held by the first housing, and the reinforcing member can be pushed into the first housing only when the first housing and the second housing are fitted together, the housing assembly of the present invention enhances the coupling strength of both the housings based on the lock arm by adding the coupling strength based on the reinforcing member, enables the operator to judge easily and reliably whether both housings are fitted together on the basis of that the reinforcing member can be pushed in, ensures smooth and reliable insertion work by holding the reinforcing member by the first housing, and allows slimming of both housings. Moreover, the housing assembly of the present invention allows a single-action fitting wherein the first housing is fitted into the second housing by only pushing the reinforcing member rearward, while reliably preventing errors of the reinforcing member.

The housing assembly of the present invention may be so structured that in said housing assembly, when the reinforcing member is at the front side position, there is a clearance in the height direction between the reinforcing member and the lock arm, the clearance allows the lock arm to flex and in turn enables fitting between the lock pawl and the fitting part and undoing such fitting, and when the reinforcing member is at the rear side position, said clearance is closed up to prevent the lock arm from flexing and in turn disables undoing of the fitting between the lock pawl and the fitting part.

With this arrangement, when the reinforcing member is at the rear side position, it is impossible to undo the fitting between the lock pawl and the fitting part. Hence this undoing of the fitting cannot be performed inadvertently, and the coupling strength between the first housing and the second housing is enhanced furthermore.

The housing assembly of the present invention may be so structured that in said housing assembly, the reinforcing member is provided with a protrusion that will contact the lock arm when the lock arm interferes with the reinforcing member.

With this arrangement, when the lock arm interferes with the reinforcing member, the lock arm will contact the protrusion. Hence the contact area will be smaller than a contact area that results when the lock arm makes plane contact with the surface of the reinforcing member. This reduces the possibility of occurrence of a trouble wherein due to frictions, the lock arm does not restore itself and is kept flexed and in turn the lock pawl and the fitting part do not fit together.

The housing assembly of the present invention may be so structured that in said housing assembly, the reinforcing member is provided, on the outer sides in the width direction of the fitting arms, with a pair of flexible holding arms extending substantially parallel to each other, from the body rearward in the depth direction, and each holding arm is provided with a hook part, which protrudes in the width direction to be caught on the first housing to prevent the reinforcing member from dropping forward in the depth direction.

With this arrangement, when the hook parts of the holding arms are caught on the first housing, the reinforcing member will be prevented from dropping out of the first housing.

The housing assembly of the present invention may be so structured that in said housing assembly, the first housing or the second housing is provided with a contact.

A pair of electric connectors of the present invention comprises said housing assembly of the present invention, a first contact provided in the first housing, and a second contact provided in the second housing, and the pair of electric connectors are so structured that when the first housing is fitted in the second housing, the first contact will contact the second contact, and when the first housing is pulled out of the second housing, the first contact will be separated from the second contact.

As the pair of electric connectors of the present invention is provided with the reinforcing member apart from the lock arm, said reinforcing member is to be held by the first housing, and said reinforcing member can be pushed into the first housing only when the first housing and the second housing are fitted together, the pair of electric connectors of the present invention can enhance the coupling strength of both the housings based on the lock arm by adding the coupling strength based on the reinforcing member, enable the operator to judge easily and reliably whether both housings are fitted together on the basis of that the reinforcing member can be pushed in, ensure smooth and reliable insertion work by holding the reinforcing member by the first housing, and slim both housings and in turn slim the electric connectors. Moreover, said pair of electric connectors can accomplish a single-action fitting wherein the first housing is fitted into the second housing by only pushing the reinforcing member rearward, while reliably preventing errors of the reinforcing member.

PREFERRED EMBODIMENT OF THE INVENTION

Figure 1:
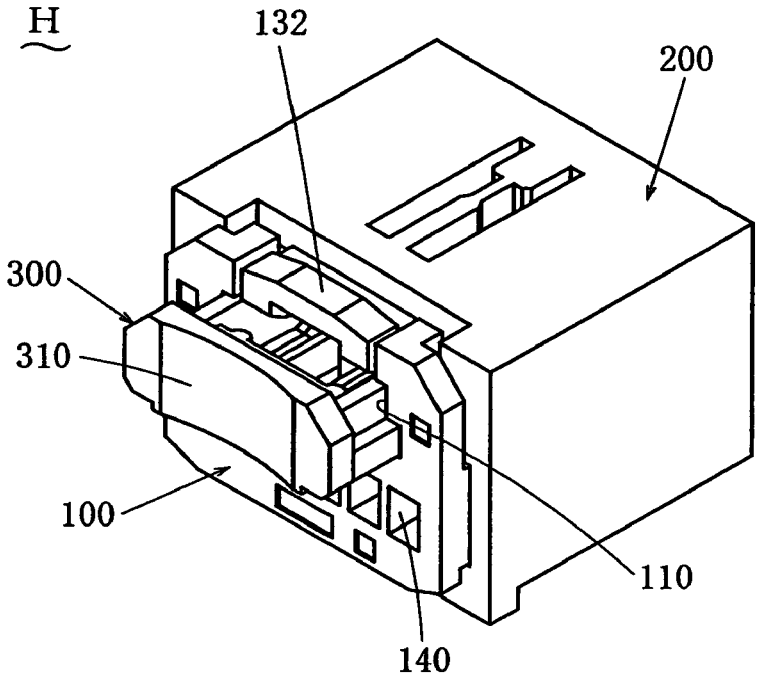
FIG. 1 is a perspective view illustrating the housing assembly of an embodiment of the present invention.
Figure 2:
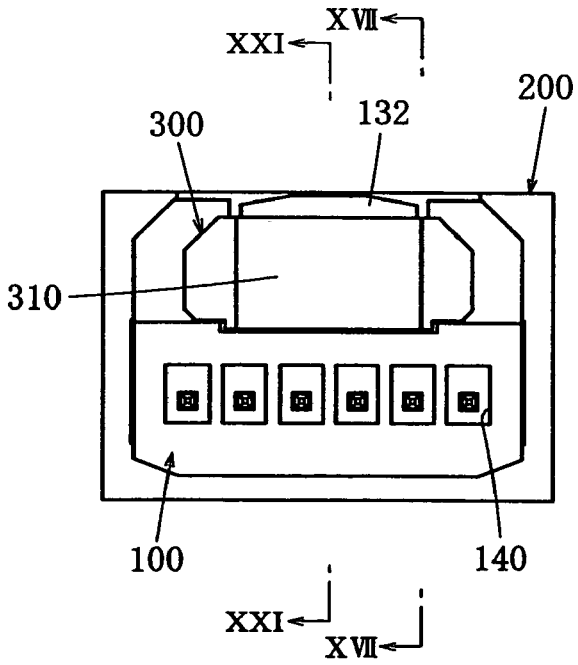
FIG. 2 is a front view of the housing assembly of the embodiment, seen from the front side in the depth direction.

In the following, the embodiment of the present invention will be described. FIG. 1 through FIG. 16 illustrate a housing assembly H of the embodiment of the present invention. The housing assembly H comprises a first housing 100 and a second housing 200 both being the insulating housings of the pair of electric connectors to be coupled together or to be disconnected from each other, and a reinforcing member 300 for enhancing the coupling strength between the housings 100, 200. The housing assembly H will become a pair of electric connectors when contacts are added so that both the first housing 100 and the second housing 200 are provided with contacts. When the first housing 100 is fitted into the second housing 200, the contacts of both housings will contact each other, and when the first housing 100 is pulled out of the second housing 200, these contacts will be separated. In the case of this embodiment, the second housing 200 is provided with the second contacts 500 by, for example, press-fitting or integral molding, and the first housing 100 is provided with chambers 140 penetrating through the housing in the depth direction and the first contacts 400 are to be fitted in these chambers 140. Because of this arrangement, in the stage of the housing assembly H, the first contacts 400 are not fitted yet, and when the first contacts 400 are fitted in the chambers 140, both the first housing 100 and the second housing 200 will be provided with their respective contacts to become a pair of electric connectors. The present invention includes a housing assembly wherein a first housing is not provided with first contacts and a second housing is provided with second contacts, a housing assembly wherein a first housing is provided with first contacts and a second housing is not provided with second contacts, a housing assembly wherein a first housing is not provided with first contacts and a second housing is not provided with second contacts, and a housing assembly wherein either one of housings is provided with a part of contacts, as its embodiments.

Figure 12:
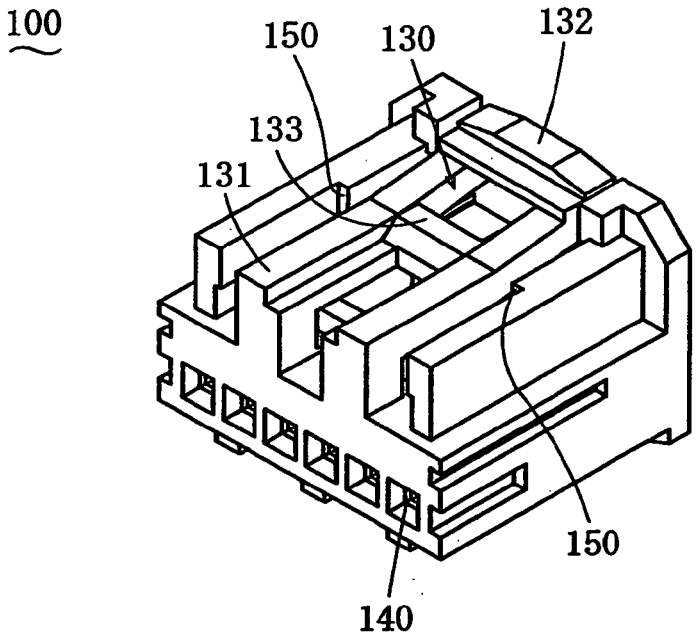
FIG. 12 is a perspective view illustrating the first housing of the housing assembly of the embodiment.
Figure 13:
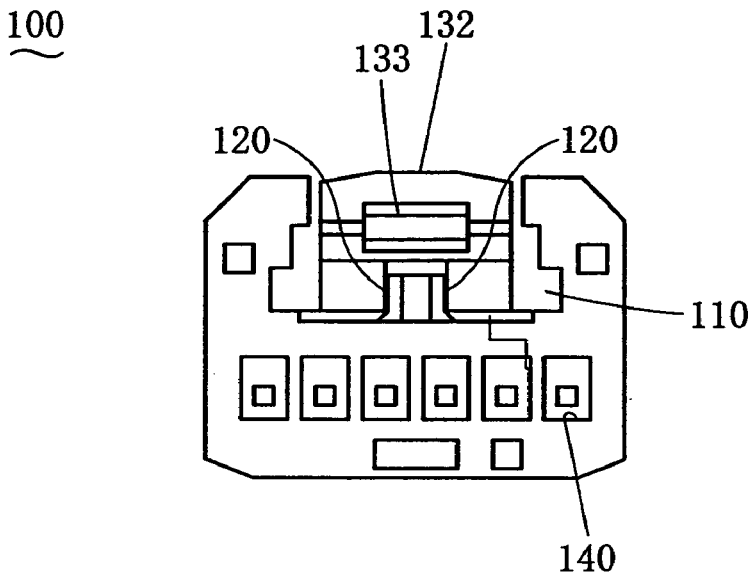
FIG. 13 is a front view of the first housing of the housing assembly of the embodiment, seen from the front side in the depth direction.

A depth direction, a width direction and a height direction all being perpendicular to each other are assumed, and this orientation is used for description. In the case of this embodiment, with reference to FIG. 17, the left-right direction of the drawing is the depth direction, the left side of the drawing is the front side in the depth direction, and the right side of the drawing is the rear side in the depth direction. The direction perpendicular to the paper plane of the drawing is the width direction, and the top-bottom direction of the drawing is the height direction. As shown in FIG. 12 and FIG. 13, the first housing 100 is formed of an insulating material into, for example, substantially a rectangular parallelepiped. As shown in FIG. 7 through FIG. 11, the second housing 200 is formed of an insulating material into, for example, substantially a box shape, and the second housing 200 is provided with a cavity 210, which opens on the front in the depth direction and into which the first housing 100 is to be fitted.

Figure 5:
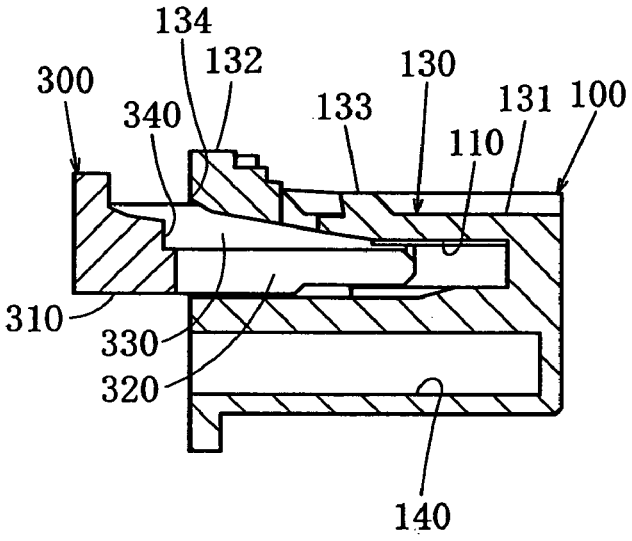
FIG. 5 is a sectional view along the line V—V of FIG. 4.
Figure 6:
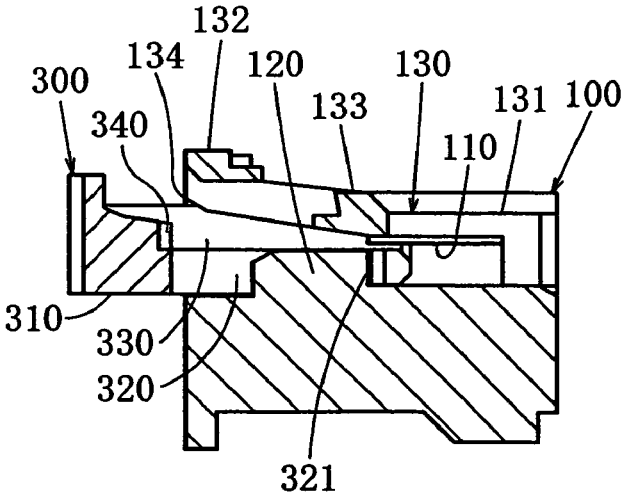
FIG. 6 is a sectional view along the line VI—VI of FIG. 4.
Figure 7:
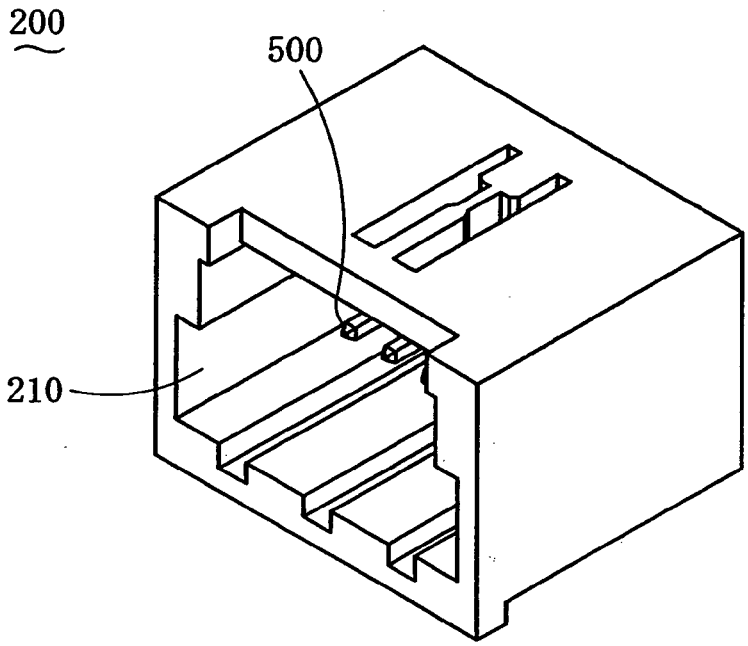
FIG. 7 is a perspective view illustrating the second housing of the housing assembly of the embodiment.
Figure 8:
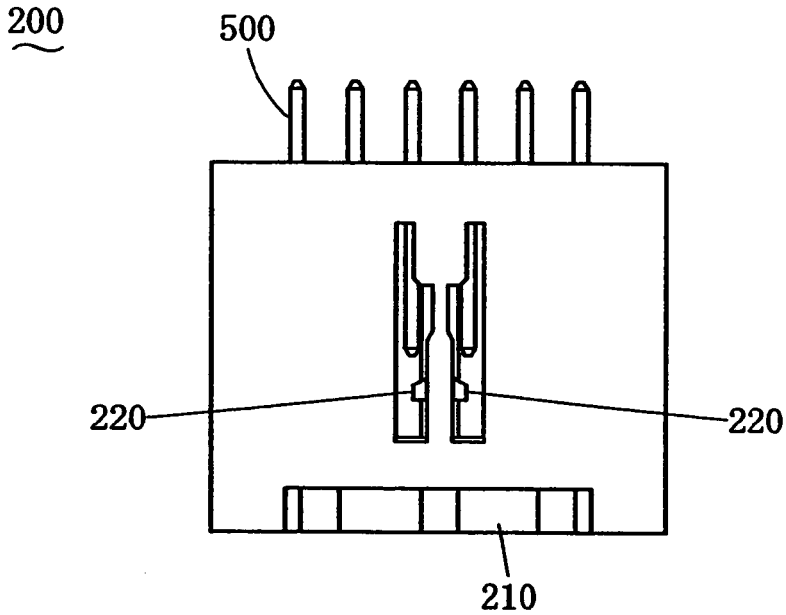
FIG. 8 is a plan view of the second housing of the housing assembly of the embodiment, seen in the height direction.
Figure 9:
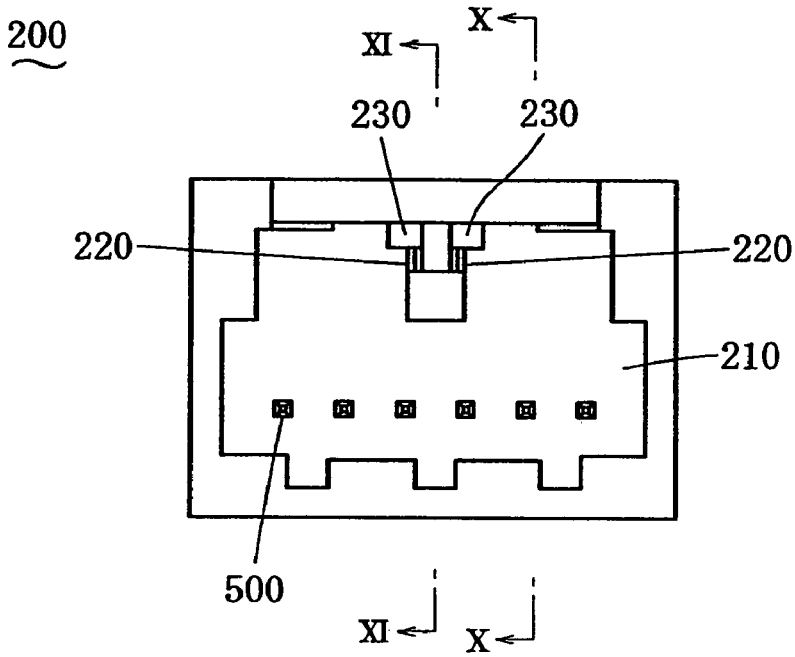
FIG. 9 is a front view of the second housing of the housing assembly of the embodiment, seen from the front side in the depth direction.
Figure 10:
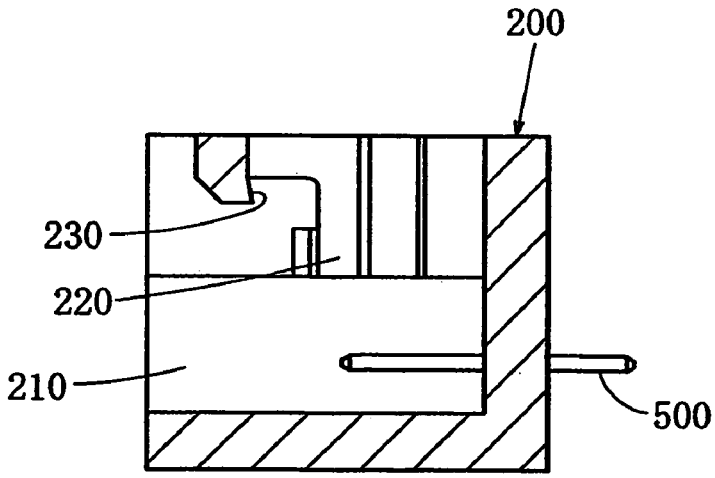
FIG. 10 is a sectional view along the line X—X of FIG. 9.
Figure 11:
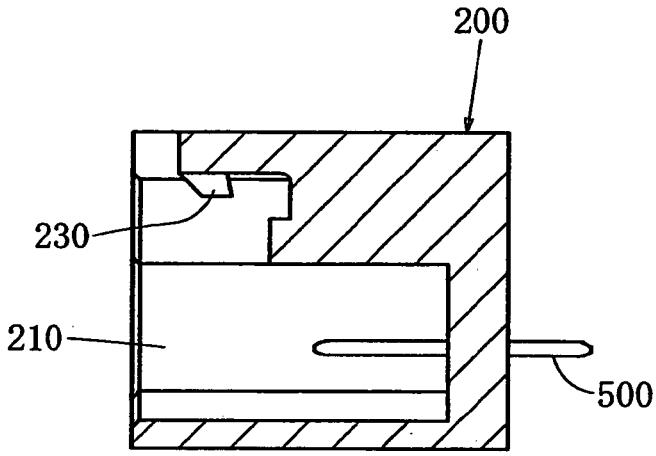
FIG. 11 is a sectional view along the line XI—XI of FIG. 9.

Both the first housing 100 and the second housing 200 are provided with locking mechanisms, which ensure or release the fitting engagement when the first housing 100 is fitted into the second housing 200. To be more specific, as shown in FIG. 5 and FIG. 6 and FIG. 12, the first housing 100 is provided with a flexible lock arm 130. An end part 131 on the rear side of the lock arm 130 is fixed onto the first housing 100, and the lock arm 130 extends from the rear side in the depth direction frontward and can be flexed toward the lower side. The lock arm 130 is constituted of, for example, a part of the outer wall of the first housing 100, or the lock arm is arranged to extend along the outer wall of the first housing 100. The lock arm 130 is provided with, on its higher side in the height direction, a protruding lock pawl 133. The lock arm 130 is provided with a manipulation part 132 at the end of the front side, however, this manipulation part 132 may be either provided or not. On the other hand, as shown in FIG. 9 and FIG. 10, of the walls facing the cavity 210 of the second housing 200, the wall being located on the higher side in relation to the cavity 210 is provided with raised fitting parts 230 protruding toward the lower side. They are so arranged that when the lock arm 130 is moved rearward, the lock arm 130 will be flexed and in turn the lock pawl 133 will get over the fitting parts 230 and come into the rear side of the fitting parts 230, namely, fitting with and engaging behind the fitting parts 230. The fitting part 230 may be plural or singular.

Figure 14:
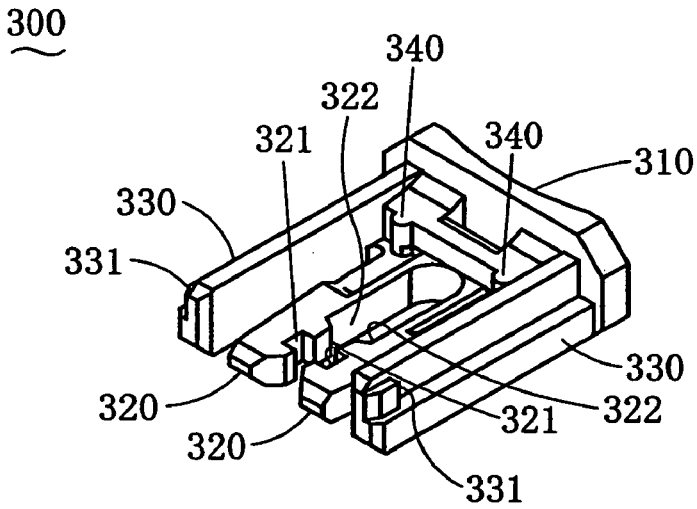
FIG. 14 is a perspective view illustrating the reinforcing member of the housing assembly of the embodiment.
Figure 15:
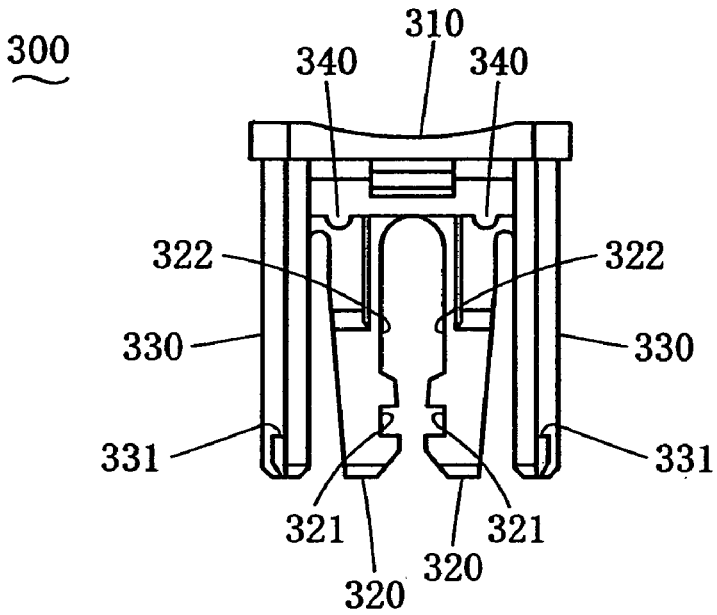
FIG. 15 is a plan view of the reinforcing member of the housing assembly of the embodiment, seen in the height direction.
Figure 16:
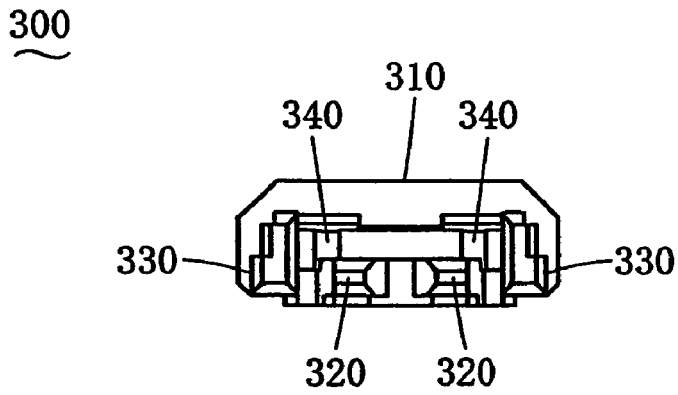
FIG. 16 is a rear view of the reinforcing member of the housing assembly of the embodiment, seen from the rear side in the depth direction.
Figure 24:
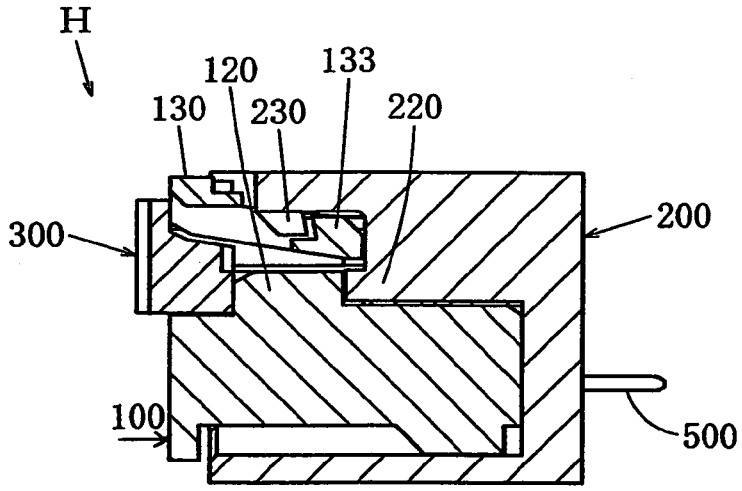
FIG. 24 is a drawing similar to FIG. 21. The first housing fits in the second housing, and the reinforcing member is at the rear side position.
Figure 30:
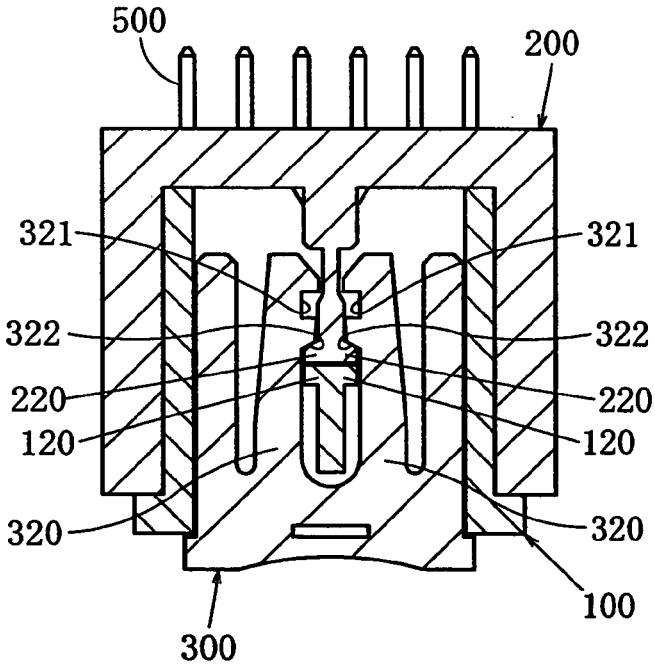
FIG. 30 is a sectional view illustrating the housing assembly of the embodiment, sectioned in the plane facing in the height direction. The reinforcing member is pressed more, in relation to the first housing, rearward in the depth direction from the state of FIG. 29. The first protruding parts and the second protruding parts are fitted in the root-end-side concaved parts to hold the reinforcing member at the rear side position.

As shown in FIG. 5, FIG. 6 and FIG. 13, the first housing 100 is provided with a receiving chamber 110, which penetrates into the first housing 100 in the depth direction. A reinforcing member 300 is inserted into this receiving chamber 110 in such a way that the reinforcing member 300 can slide in the depth direction. As shown in FIG. 14 through FIG. 16, the reinforcing member 300 is provided with a body 310 serving as a manipulation part, and a pair of fitting arms 320 extending from the body 310 rearward in the depth direction as will be described later. The reinforcing member 300 is inserted into the receiving chamber 110 in such a way that the member can be slid between a front side position wherein the body 310 is on the front side, in the depth direction, of the first housing (the position illustrated in FIG. 17 through FIG. 19, FIG. 21 through FIG. 23, and FIG. 25 through FIG. 27) and a rear side position being on the rear side, in the depth direction, of the front side position (the position shown in FIG. 20, FIG. 24 and FIG. 30).

As shown in FIG. 13, and FIG. 25 through FIG. 30, inside the receiving chamber 110 of the first housing 100, the first protruding parts 120 are located to protrude to both sides in the width direction, and the first protruding parts 120 are fixed on the first housing 100. As shown in FIG. 8 through FIG. 10, and FIG. 25 through FIG. 30, inside the cavity 210 of the second housing 200, the second protruding parts 220 are located to protrude to both sides in the width direction, and the second protruding parts 220 are fixed on the second housing 200. As shown in FIG. 14 through FIG. 16, and FIG. 25 through FIG. 30, the reinforcing member 300 is provided with a pair of flexible fitting arms 320, which extend from the body 310 to the rear in the depth direction. This pair of fitting arms 320 are provided in the width direction so that they are parallel to each other. Each fitting arm 320 is provided with a top-end-side concaved part 321, which concaves from the inner side toward the outer side in the width direction and is to fit with the first protruding part 120 when the reinforcing member 300 is at the front side position. Moreover, each fitting arm 320 is provided with a root-end side concaved part 322, which concaves from the inner side toward the outer side in the width direction on the front side of the top-end-side concaved part 321 in the depth direction and which is to fit with the first protruding part 120 and the second protruding part 220 when the first housing 100 fits in the cavity 210 of the second housing 200 and the reinforcing member 300 is at the rear side position. The inner side in the width direction of the fitting arm 320 is on the near side to the other fitting arm 320, and the outer side in the width direction of the fitting arm 320 is on the far side from the other fitting arm 320.

Figure 3:
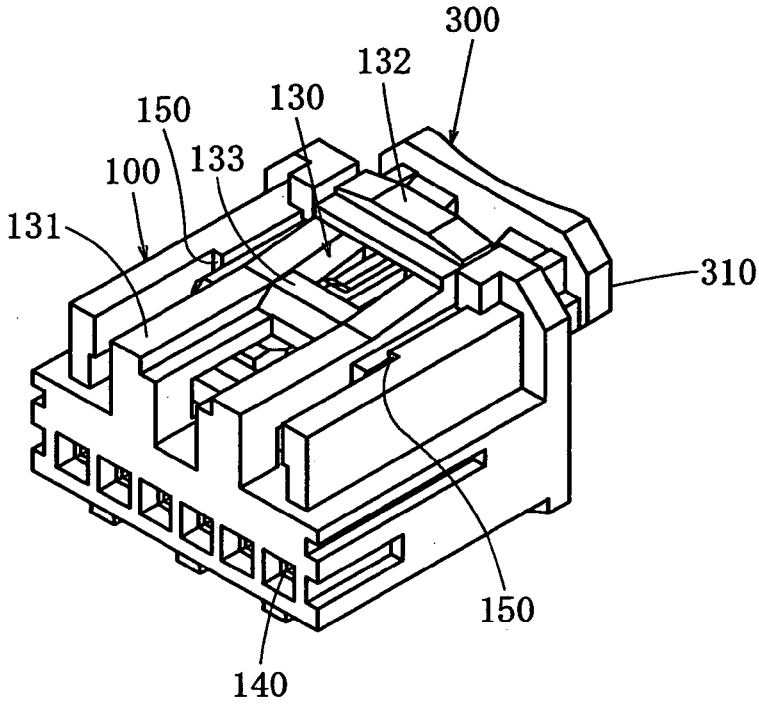
FIG. 3 is a perspective view illustrating the first housing and a reinforcing member of the housing assembly of the embodiment.
Figure 4:
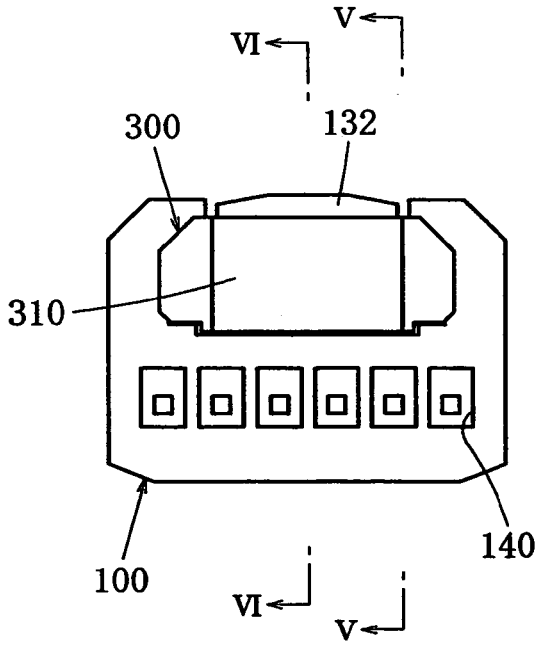
FIG. 4 is a front view of the first housing and the reinforcing member of the housing assembly of the embodiment, seen from the front side in the depth direction.
Figure 17:
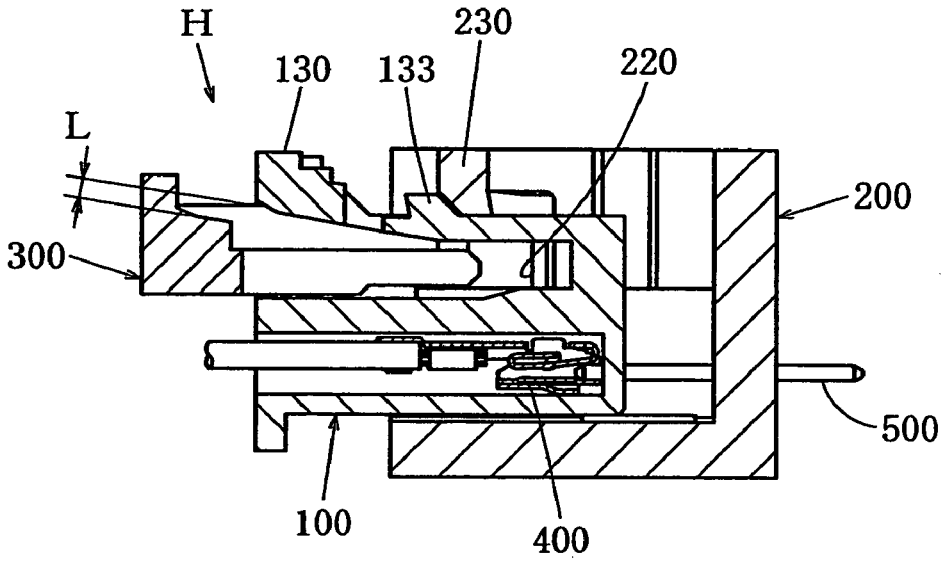
FIG. 17 is a sectional view of the pair of electric connectors of the embodiment, sectioned at a position corresponding to the line XVII—XVII of FIG. 2. The first housing is being inserted into the second housing, and the reinforcing member is at a front side position.
Figure 18:
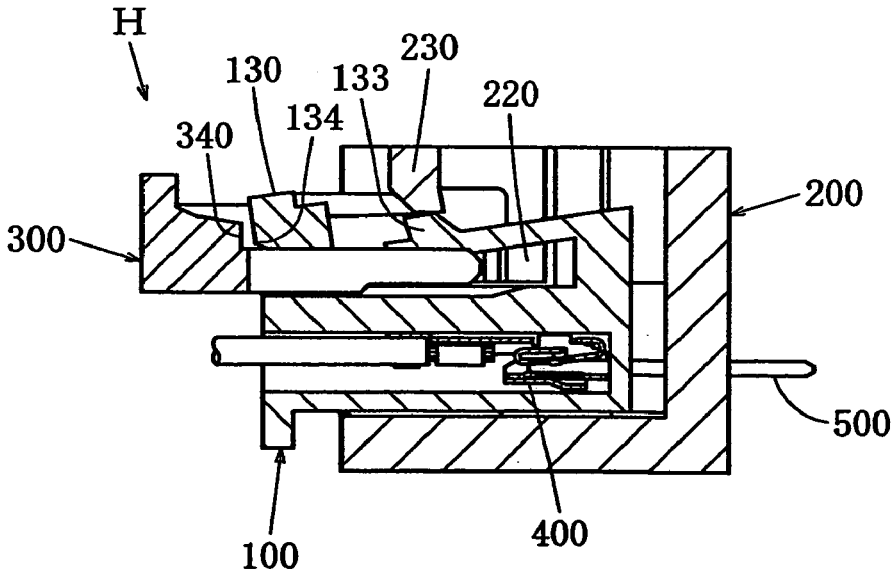
FIG. 18 is a sectional view of the pair of the electric connectors of the embodiment and a drawing similar to FIG. 17. The first housing is being inserted into the second housing, a locking pawl is overcoming a fitting part, and the reinforcing member is at the front side position.
Figure 21:
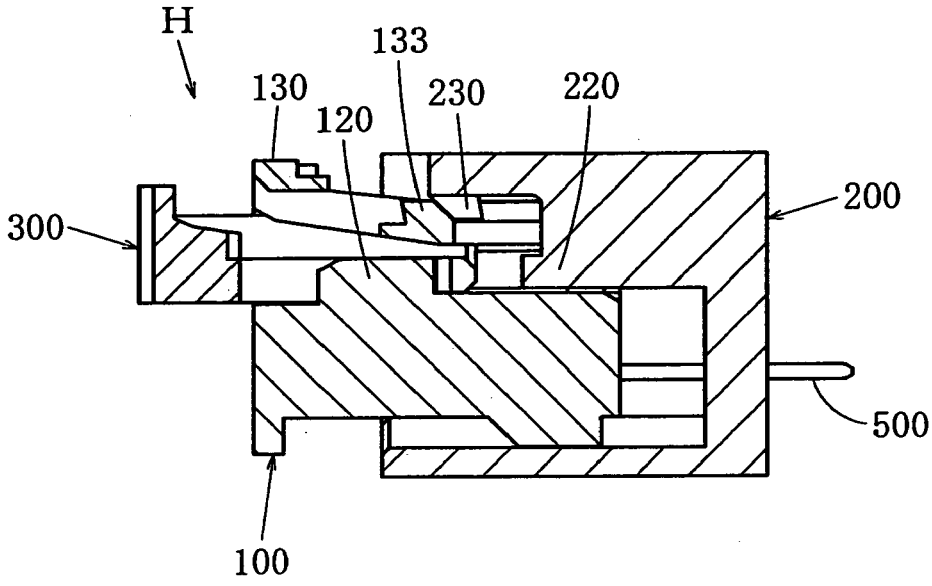
FIG. 21 is a sectional view of the pair of the electric connectors of the embodiment, sectioned at a position corresponding to the line XXI—XXI of FIG. 2. The first housing is being inserted into the second housing, and the reinforcing member is at the front side position.
Figure 22:
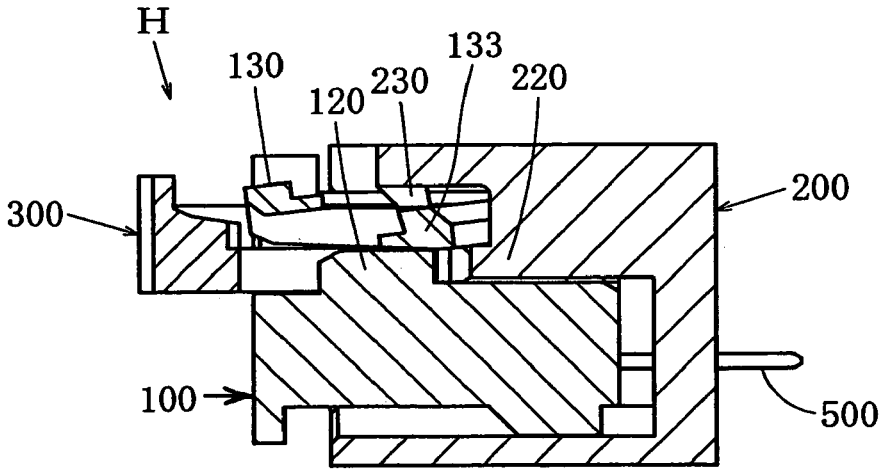
FIG. 22 is a sectional view of the pair of electric connectors of the embodiment and a drawing similar to FIG. 21. The first housing is being inserted into the second housing, the locking pawl is overcoming the fitting part, and the reinforcing member is at the front side position.
Figure 23:
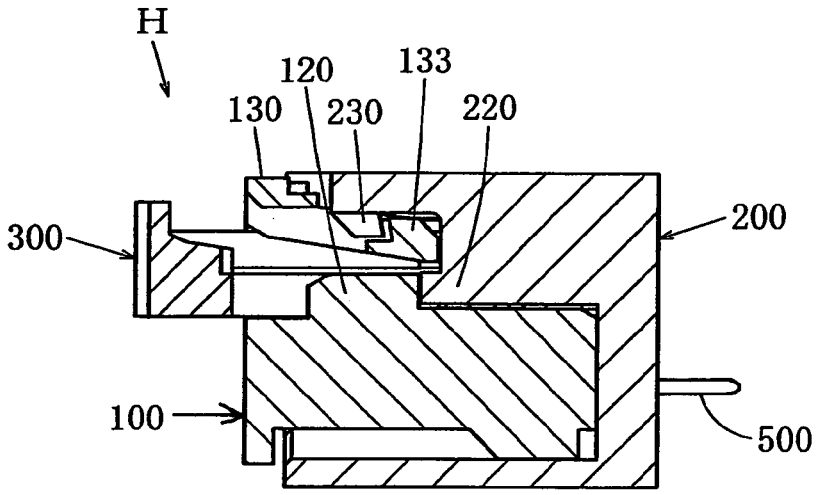
FIG. 23 is a drawing similar to FIG. 21. The first housing fits in the second housing, and the reinforcing member is at the front side position.
Figure 25:
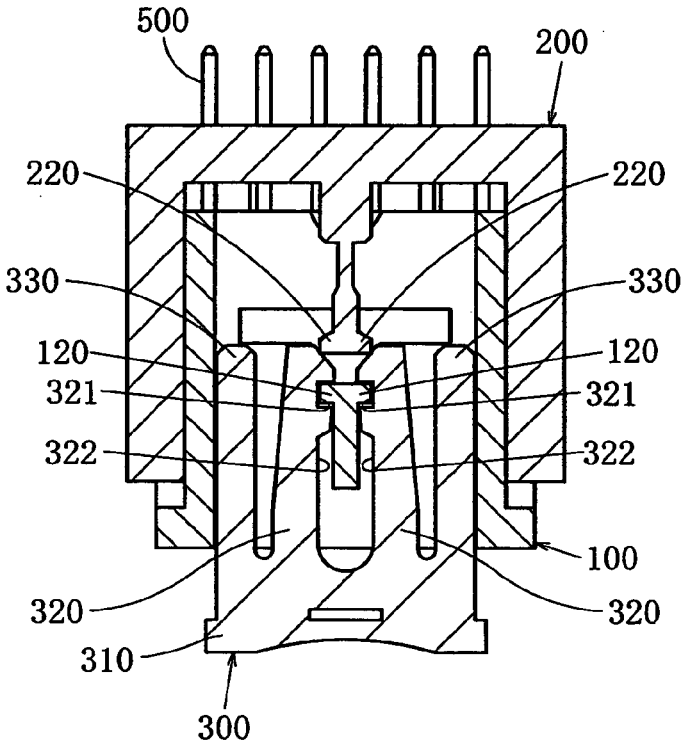
FIG. 25 is a sectional view of the housing assembly of the embodiment, sectioned in a plane facing in the height direction. The first housing is being inserted into the second housing, and top-end-side concaved parts of the reinforcing member fit with first protruding parts to hold the reinforcing member at the front side position.
Figure 26:
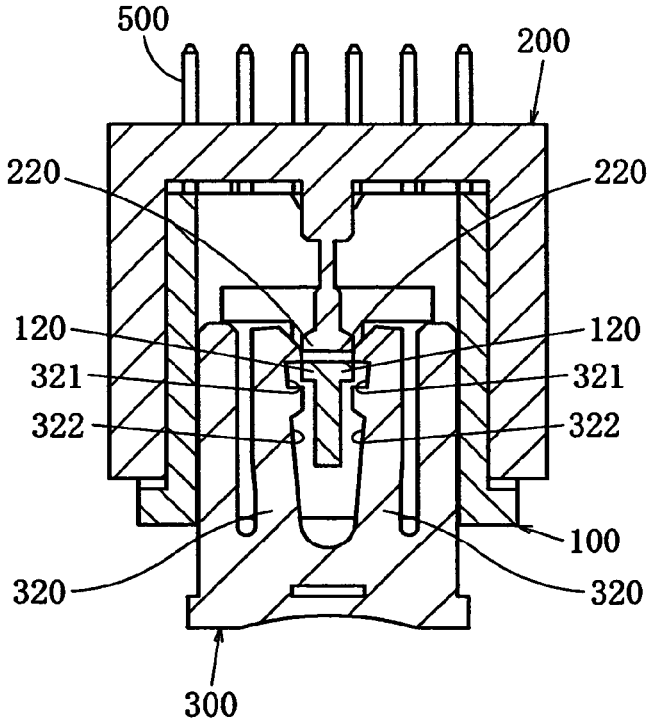
FIG. 26 is a sectional view of the housing assembly of the embodiment, sectioned in the plane facing in the height direction. The first housing is almost fitting into the second housing, and second protruding parts are pushing away the fitting arms to both sides in the width direction to disconnect the first protruding parts from the top-end-side concaved parts.
Figure 27:
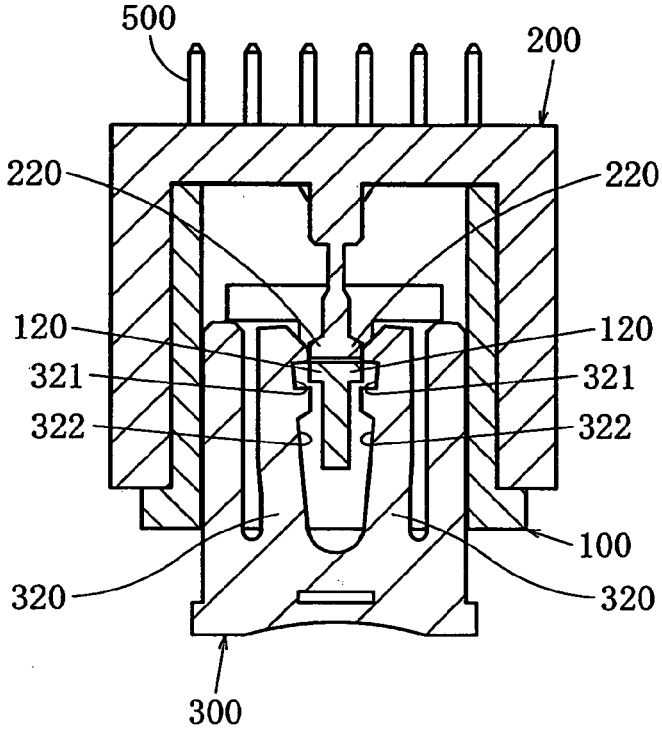
FIG. 27 is a sectional view illustrating the housing assembly of the embodiment, sectioned in a plane facing in the height direction. The first housing fits in the second housing, and the second protruding parts are pushing away the fitting arms to both sides in the width direction to disconnect the first protruding parts from the top-end-side concaved parts so that the reinforcing member can be pushed, in relation to the first housing, toward the rear in the depth direction.
Figure 28:
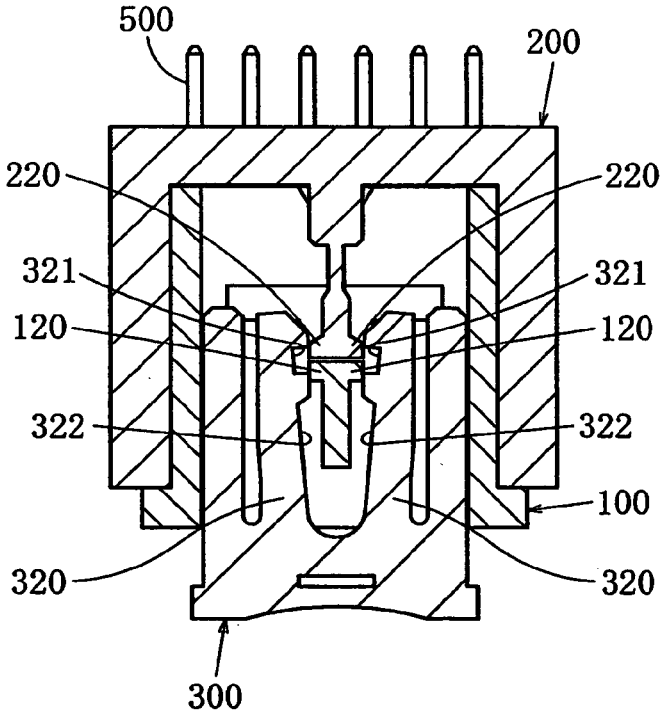
FIG. 28 is a sectional view illustrating the housing assembly of the embodiment, sectioned in the plane facing in the height direction. The reinforcing member is being pushed from the state shown in FIG. 27, in relation to the first housing, toward the rear in the depth direction.
Figure 29:
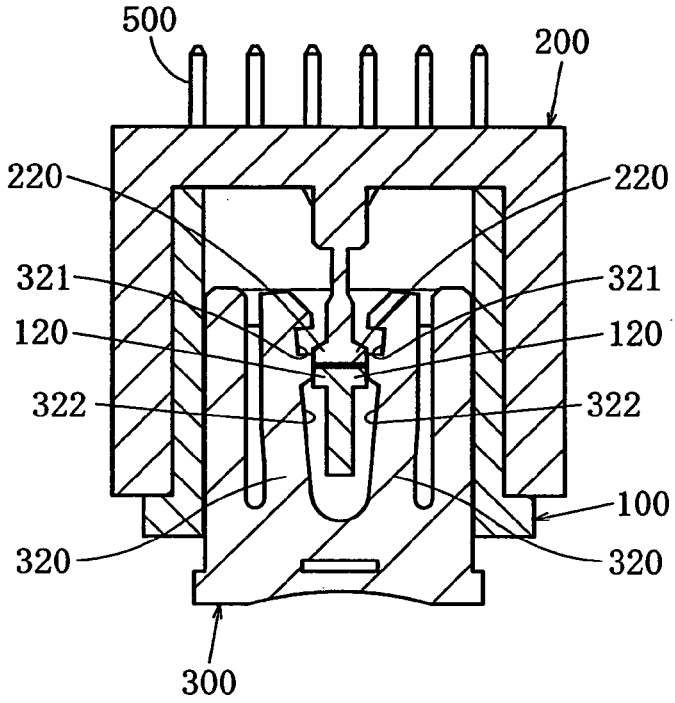
FIG. 29 is a sectional view illustrating the housing assembly of the embodiment, sectioned in the plane facing in the height direction. The reinforcing member is being pressed furthermore rearward in the depth direction from the state shown in FIG. 28 in relation to the first housing.

This housing assembly H is structured to function as follows. First, as shown in FIG. 3, FIG. 5 and FIG. 6, the reinforcing member 300 is held at the front side position by fitting the top-end-side concaved parts 321 and the first protruding parts 120 together. Next, as shown in FIG. 17, FIG. 21 and FIG. 25, the first housing 100 is inserted into the cavity 210 of the second housing 200. When the reinforcing member 300 or the first housing 100 is pushed rearward toward the second housing 200, as shown in FIG. 18 and FIG. 22, the lock arm 130 will be flexed downwardly by the fitting parts 230 deflecting the locking pawl 133 downwardly, so that the flexed lock arm 130 will interfere with or will be able to interfere with the reinforcing member 300 to prevent the reinforcing member 300 from sliding rearward into the first housing 100, and as shown in FIG. 26 the fitting arms 320 will be pushed by the second protruding parts 220 to move to both sides in the width direction, in other words, the fitting arms 320 will move outward in the width direction, respectively, and this in turn will release the top-end-side concaved parts 321 from the first protruding parts 120. In this context, the expression that the flexed lock arm 130 interferes with the reinforcing member 300 means that the flexed lock arm 130 directly contacts the reinforcing member 300. This occurs, for example, when the reinforcing member 300 is pushed rearward toward the second housing 200. The expression that the flexed lock arm 130 will be able to interfere with the reinforcing member 300 means that although the flexed lock arm 130 is not contacting the reinforcing member 300, but if under the same condition the reinforcing member 300 is pushed rearward, the reinforcing member 300 will directly contact the flexed lock arm 130. This occurs, for example, when the first housing 100 is pushed rearward toward the second housing 200. Moreover, when the first housing 100 is inserted further into the cavity 210 of the second housing 200 and the first housing 100 is fitted in the cavity 210 of the second housing 200, the lock arm 130 will resume its free state and return upward due to fitting between the lock pawl 133 and the fitting parts 230, allowing the reinforcing member 300 to slide rearward into the first housing 100 (the state illustrated in FIG. 1, FIG. 19, FIG. 23 and FIG. 27). As shown in FIG. 28 and FIG. 29, when the reinforcing member 300 is pushed rearward into the first housing 100, and the reinforcing member 300 is pushed to the rear side position, the root-end-side concaved parts 322 will fit with the first protruding parts 120 and the second protruding parts 220 (the state illustrated in FIG. 20, FIG. 24 and FIG. 30).

The operation ranging from starting to insert the first housing 100 into the cavity 210 of the second housing 200 to fitting the root-end-side concaved parts 322 with the first protruding parts 120 and the second protruding parts 220 is done by a single-action operation wherein only the reinforcing member 300 is pushed to effect a series of actions all at once or by a two-action operation wherein actions are done in two stages. In the case of the single-action operation, the force pushing the reinforcing member 300 is transmitted to the first housing 100 by the fitting relationship between the top-end-side concaved parts 321 of the fitting arms 320 and the first protruding parts 120. Next, when the top-end-side concaved parts 321 are released from the first protruding parts 120, as the flexed lock arm 130 interferes with the reinforcing member 300, the force pushing the reinforcing member 300 will be transmitted to the first housing via the lock arm 130. When the lock arm 130 restores itself, the force pushing the reinforcing member 300 will become a force making the reinforcing member 300 slide rearward into the first housing 100. As a result, the root-end-side concaved parts 322 will be fitted with the first protruding parts 120 and the second protruding parts 220. In the case of the two-action operation, the first operation is to push the first housing 100 rearward into the second housing 200. Actions ranging from starting to insert the first housing 100 into the cavity 210 of the second housing 200 to fitting the first housing 100 into the cavity 210 of the second housing 200 are done by this first operation. During this operation, the top-end-side concaved parts 321 will be released from the first protruding parts 120, and the flexed lock arm 130 will interfere with or will be able to interfere with the reinforcing member 300, and the lock arm 130 will restore itself. Next, when the second operation of pushing the reinforcing member 300 rearward into the first housing 100 is done, the force pushing the reinforcing member 300 will become a force making the reinforcing member 300 slide rearward into the first housing 100, and this will fit the root-end-side concaved parts 322 with the first protruding parts 120 and the second protruding parts 220.

Figure 19:
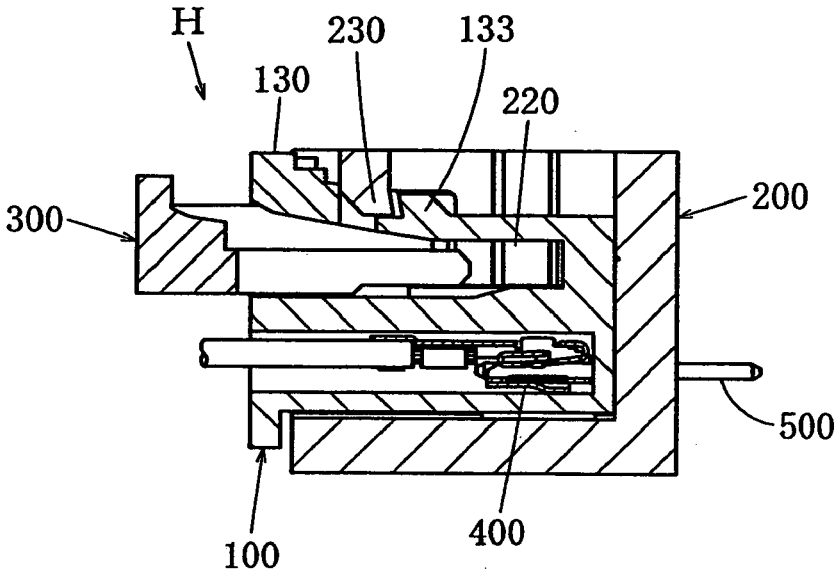
FIG. 19 is a sectional view of the pair of the electric connectors of the embodiment and a drawing similar to FIG. 17. The first housing fits in the second housing, and the reinforcing member is at the front side position.

The function of the flexed lock arm 130, which interferes with or is able to interfere with the reinforcing member 300 so as to prevent the reinforcing member 300 from sliding rearward into the first housing 100, will be described in detail below. As shown in FIG. 18, when the reinforcing member 300 is at the front side position and is being held by the first housing 100, if the reinforcing member 300 or the first housing 100 is pushed rearward toward the second housing 200, the lock pawl 133 collides with and attempts to get over the fitting parts 230, whereby the lock pawl 133 and therewith the lock arm 130 will be pushed by the fitting parts 230 to flex to the lower side, and the end part 134 on the front side in the depth direction of the lock arm 130 will be displaced to the lower side to settle on the rear side of the body 310 of the reinforcing member 300. As a result, the lock arm 130 will interfere with or will be able to interfere with the reinforcing member 300 to prevent the reinforcing member 300 from sliding to the rear side position. Then, as shown in FIG. 19, when the first housing 100 is fitted in the cavity 210 of the second housing 200, the lock arm 130 will restore itself to the free state when the lock pawl 133 passes by and settles on the rear side of the fitting parts 230. Thereby the end part 134 on the front side in the depth direction of the lock arm 130 will be displaced to the higher side in the height direction to leave a space on the rear side of the body 310 of the reinforcing member 300 and allow the reinforcing member 300 to slide rearward into the first housing 100.

Figure 20:
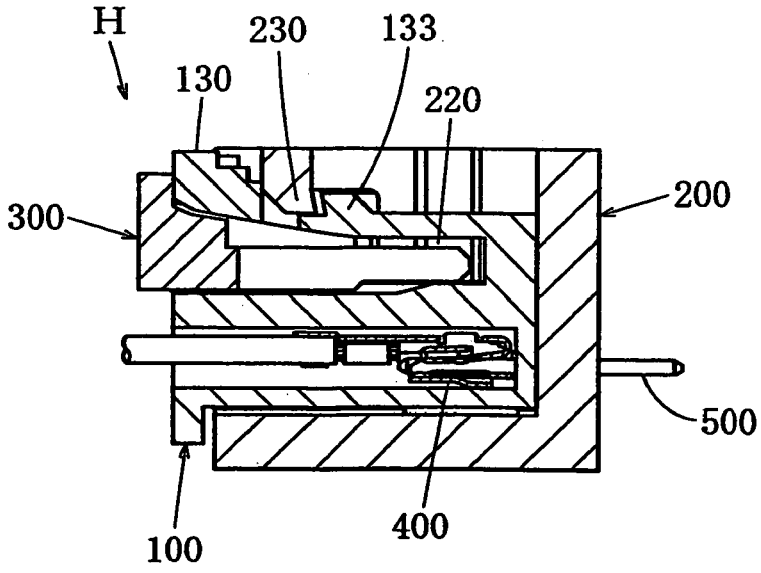
FIG. 20 is a sectional view of the pair of electric connectors of the embodiment and a drawing similar to FIG. 17. The first housing fits in the second housing, and the reinforcing member is in the rear side position.

This housing assembly H is so structured, as shown in FIG. 17, that when the reinforcing member 300 is at the front side position, there is a clearance L in the height direction between the reinforcing member 300 and the lock arm 130, and this clearance L allows the lock arm 130 to flex and in turn enables fitting between the lock pawl 133 and the fitting parts 230 and undoing such fitting, and when the reinforcing member 300 is at the rear side position as shown in FIG. 20, the above-mentioned clearance L is closed up to prevent the lock arm 130 from flexing and in turn disables undoing of the fitting between the lock pawl 133 and the fitting parts 230.

As shown in FIG. 5, FIG. 6, and FIG. 14 through FIG. 20, the reinforcing member 300 is provided with protrusions 340, which contact the lock arm 130 when the lock arm 130 interferes with the reinforcing member 300. These protrusions 340 are formed on the body 310 of the reinforcing member 300 to protrude rearward in the depth direction, and are so structured that when the lock arm 130 is pushed by the fitting parts 230 to flex to the lower side, the contact area between the frontward-facing face of the end part 134 on the front side in the depth direction of the lock arm 130 will be smaller than a contact area that results when the frontward-facing face of the above-mentioned end part 134 of the lock arm 130 makes plane contact with the surface of the body 310 of the reinforcing member 300. The protrusion 340 may be plural or singular.

As shown in FIG. 14 through FIG. 16, the above-mentioned reinforcing member 300 is provided, on the outer sides in the width direction of the fitting arms 320, with a pair of flexible holding arms 330 extending substantially parallel to each other, from the body 310 rearward in the depth direction, and each holding arm 330 is provided with a hook part 331 protruding in the width direction. On the other hand, the first housing 100 is provided with holding parts 150 being concaved in the width direction. Thus when the hook parts 331 are held by the holding parts 150, the reinforcing member 300 cannot come off forward in the depth direction.

In the case of the housing assembly H of this embodiment, when the first contacts 400 are mounted on the first housing 100, the housing assembly H will become a pair of electric connectors, and when the first housing 100 fits in the second housing 200, both the contacts 400 and the contacts 500 will contact each other, and when the first housing 100 is withdrawn out of the second housing 200, the contacts 400 and the contacts 500 will be separated from each other (refer to FIG. 17 through FIG. 20).

When the reinforcing member 300 is held at the front side position by fitting the top-end-side concaved parts 321 with the first protruding parts 120, the first housing 100 is inserted into the cavity 210 of the second housing 200, and the reinforcing member 300 or the first housing is pushed rearward toward the second housing 200, the lock arm 130 will be pushed by the fitting parts 230 of the second housing 200 to flex to the lower side, the flexed lock arm 130 will interfere with or will be able to interfere with the reinforcing member 300 and prevent the reinforcing member 300 from sliding rearward into the first housing 100, and the fitting arms 320 will run into the second protruding parts 220 to move to both sides in the width direction and release the top-end-side concaved parts 321 from the first protruding parts 120. When the first housing 100 fits in the cavity 210 of the second housing 200, the lock pawl 133 will get over the fitting parts 230 of the second housing 200 and after that the lock arm 130 will restore itself and the lock pawl 133 will fit with the fitting parts 230, and as a result of this, the reinforcing member 300 will be allowed to slide rearward into the first housing 100. Next, when the reinforcing member 300 is pushed to the rear side position in relation to the first housing 100, the fitting arms 320 will restore themselves due to their flexibility, and in turn, the root-end-side concaved parts 322 will fit with the first protruding parts 120 and the second protruding parts 220. As described above, the reinforcing member 300 never slides from the front side position to the rear side position before the first housing 100 is fitted in the second housing 200. Hence errors such as that the top-end-side concaved parts 321 of the reinforcing member 300 fit with the second protruding parts 220 before the fitting of the housings 100, 200 and that root-end-side concaved parts 322 fit with the first protruding parts 120 or the second protruding parts 220 before the fitting of the housings 100, 200 are prevented. Moreover, the fitting with a single action, wherein only the reinforcing member 300 is pushed rearward to fit the first housing 100 into the second housing 200, can be made. On the other hand, inversely when the reinforcing member 300 is pulled to the front side position in relation to the first housing 100, and the manipulating part 132 of the lock arm 130 is flexed to shift the lock pawl 133 to the lower side, the fitting between the lock pawl 133 and the fitting parts 230 will be undone, and in turn, the first housing 100 can be withdrawn out of the second housing 200.

In that case of fitting, as the root-end-side concaved parts 322 of the reinforcing member 300 fit with the first protruding parts 120 and the second protruding parts 220, the coupling strength due to this reinforcing member 300 is added to the coupling strength due to the fitting between the lock arm 130 and the fitting parts 230. Hence the coupling strength between the first housing 100 and the second housing 200 is enhanced. Moreover, if the first housing 100 is not fitted completely but only partially in the cavity 210 of the second housing 200, the flexed lock arm 130 will interfere with or will be able to interfere with the reinforcing member 300 to prevent the reinforcing member 300 from sliding rearward into the first housing 100, thus it will not be possible to push the reinforcing member 300 rearward. Also, the engagement of the top-end-side concaved parts 321 with the first protruding parts 120 prevents the reinforcing member 300 from being pushed into the first housing 100 until the fitting arms 320 are flexed outwardly by interaction with the second protruding parts 220 of the second housing 200. On the basis of this, the operator can easily and properly judge that the first housing 100 is not fitted in the second housing 200, thus defective fitting can be prevented. Moreover, at the time of starting to insert the first housing 100 into the cavity 210 of the second housing 200, as the reinforcing member 300 is held in the first housing 100 by the fitting of the top-end-side concaved parts 321 and the first protruding parts 120, the reinforcing member 300 is prevented from dropping out of the housing assembly H, and the fitting work can be done smoothly and reliably. Moreover, as the fitting arms 320 of the reinforcing member 300 flex in the width direction, the first housing 100 and the second housing 200 can be made slimmer or smaller in the height direction in comparison with the conventional connector housings, which are provided with a flexible beam that flexes in the height direction.

The present invention does not limit the relative positional relationship between the reinforcing member and the lock arm when the reinforcing member is at the front side position or at the rear side position. Of these embodiments, the above-mentioned embodiment is so structured that when the reinforcing member 300 is at the front side position, there is a clearance L in the height direction between the reinforcing member 300 and the lock arm 130, and this clearance L allows the lock arm 130 to flex and in turn enables fitting between the lock pawl 133 and the fitting parts 230 and enables undoing such fitting. On the other hand, when the reinforcing member 300 is at the rear side position, the above-mentioned clearance L is closed to prevent the lock arm 130 from flexing, which in turn disables undoing or disengaging of the fitting between the lock pawl 133 and the fitting parts 230. With this arrangement, when the reinforcing member 300 is at the rear side position, it is impossible to undo the fitting between the lock pawl 133 and the fitting parts 230, hence this undoing or disengaging of the fitting cannot be done inadvertently, and the coupling strength between the first housing 100 and the second housing 200 is enhanced furthermore.

The present invention includes an embodiment wherein the frontward-facing face of the end part on the front side in the depth direction of the lock arm makes, with substantially entire surface thereof, plane contact with the surface of the reinforcing member. Of these embodiments, in the above-mentioned embodiment, the reinforcing member 300 is provided with protrusions 340, which contact the frontward-facing face of the end part 134 on the front side in the depth direction of the lock arm 130 when the lock arm 130 interferes with the reinforcing member 300. With this arrangement, when the lock arm 130 is flexed to interfere with the reinforcing member 300, the lock arm 130 will contact the protrusions 340. Hence the contact area will be smaller than a contact area that results when the substantially entire surface of the frontward-facing face of the end part 134 of the lock arm 130 makes plane contact with the surface of the reinforcing member 300. This reduces the possibility of occurrence of a trouble wherein due to frictions between two faces substantially facing in the depth direction, the lock arm 130 does not restore itself and is kept flexed and in turn the lock pawl 133 and the fitting parts 230 do not fit together.

The present invention includes an embodiment wherein the reinforcing member is not provided with a holding arm. However, in the case of the above-mentioned embodiment, the reinforcing member 300 is provided, on the outer sides in the width direction of the fitting arms 320, with a pair of flexible holding arms 330 extending substantially parallel to each other, from the body 310 rearward in the depth direction, and each holding arm 330 is provided with a hook part 331 protruding in the width direction. This hook part 331 is to be caught on the first housing 100 to prevent the reinforcing member 300 from dropping forward in the depth direction. With this arrangement, when the hook parts 331 of the holding arms 330 are caught on the first housing 100, the reinforcing member 300 cannot drop out of the first housing 100.

The present invention does not limit the configurations of the contacting parts of both the fitting arms and the second protruding parts. However, as shown in FIG. 25 through FIG. 30, if the edge part on the inner side in the width direction and at the rear end of each fitting arm 320 is chamfered, when the fitting arms 320 run into the second protruding parts 220 to move to both sides in the width direction, this action will be done smoothly, hence it is preferable to do so. Inversely, the edge parts at both ends in the width direction and at the front side end of the second protruding parts may be chamfered. Or they may be used together. Moreover, as shown in FIG. 25 through FIG. 30, if the portions forming the rear ends of the root-end-side concaved parts 322 of the fitting arms 320 and the edge parts on both sides in the width direction and at the rear end of the second protruding parts 220 are chamfered, when the reinforcing member 300 is pulled to the front side position, this action will be done smoothly, hence it is preferable to do so. Without chamfering both members as mentioned above, either one member may be chamfered. When the first housing 100 is to be inserted into the second housing 200, it is not necessary to start the action wherein the flexed lock arm 130 interferes with or is able to interfere with the reinforcing member 300 to prevent the reinforcing member 300 from sliding rearward into the first housing 100 immediately after the start of inserting the first housing 100 into the second housing 200. It is sufficient to start the action before the action, wherein the fitting arms 320 run into the second protruding parts 220 to move to both sides in the width direction and release the top-end-side concaved parts 321 from the first protruding parts 120, takes place.

With the description of the embodiment above, the housing assembly wherein the first housing or the second housing is provided with a contact has been disclosed. Moreover, the pair of electric connectors, which comprise the housing assembly of the present invention, the first contact provided in the first housing and the second contact provided in the second housing, and is so structured that when the first housing is fitted with the second housing, the first contact will connect to the second contact, and when the first housing is pulled out of the second housing, the first contact will be separated from the second contact, have been fully disclosed. The present invention includes embodiments that appropriately combine features of the above-mentioned embodiments.

What is claimed is:

1. A housing assembly comprising an insulating first housing and an insulating second housing of a pair of electric connectors to be coupled or uncoupled, and a reinforcing member for enhancing the coupling strength of these housings, wherein with reference to a depth direction, a width direction and a height direction all being perpendicular to each other, the second housing is provided with a cavity, which opens on a front side in the depth direction and into which the first housing is to be fitted, the first housing is provided with a lock arm, which extends from a rear side to a front side in the depth direction and can be flexed to a lower side and is provided with a lock pawl on a higher side thereof, of walls facing the cavity in the second housing, a wall on a higher side in relation to the cavity is provided with a fitting part, which fits with the lock pawl when the lock arm shifts rearward and only after the lock pawl gets over the fitting part through flexure of the lock arm, the first housing is provided with a receiving chamber, which penetrates into the first housing in the depth direction, the reinforcing member having a body is inserted into the receiving chamber such that the reinforcing member can be slid between a front side position wherein the body is on the front side of the first housing and a rear side position being displaced rearwardly from the front side position, inside the receiving chamber of the first housing, first protruding parts are fixed on the first housing and protrude laterally outwardly to both sides in the width direction, inside the cavity of the second housing, second protruding parts are fixed on the second housing and protrude laterally outwardly to both sides in the width direction, the reinforcing member is provided with a pair of flexible fitting arms, which are adapted to flex laterally in the width direction, and which extend rearward from the body and are spaced apart in the width direction and are substantially parallel to each other, each one of the fitting arms is respectively provided with a top-end-side concaved part, which concaves from an inner side toward an outer side in the width direction and is to fit with a respective one of the first protruding parts when the reinforcing member is at the front side position, and each one of the fitting arms is respectively further provided with a root-end-side concaved part, which concaves from the inner side toward the outer side in the width direction at a location forward from the top-end-side concaved part in the depth direction and which is to fit with a respective one of the first protruding parts and a respective one of the second protruding parts when the first housing fits in the cavity of the second housing and the reinforcing member is at the rear side position, and the housing assembly is so structured that when the reinforcing member is held at the front side position by fitting the top-end-side concaved parts and the first protruding parts together, then the first housing is inserted into the cavity of the second housing, and the reinforcing member or the first housing is pushed rearward toward the second housing, the lock arm is flexed and brought into a position in which the lock arm will interfere with the reinforcing member to prevent the reinforcing member from sliding rearward into the first housing, and the fitting arms will be pushed by the second protruding parts to move apart from one another laterally outwardly to both sides in the width direction and thereby release the top-end-side concaved parts from the first protruding parts, and when the first housing is fitted in the cavity of the second housing, the lock arm will be at least partially restored by unflexing due to fitting of the lock pawl with the fitting part, allowing the reinforcing member to slide rearward into the first housing, and when the reinforcing member is pushed to the rear side position in relation to the first housing, the root-end-side concaved parts will receive and fit with both the first protruding parts as well as the second protruding parts.

2. The housing assembly as recited in claim 1, so structured in that when the reinforcing member is at the front side position, there is a clearance in the height direction between the reinforcing member and the lock arm, the clearance allows the lock arm to flex and in turn enables fitting between the lock pawl and the fitting part and undoing such fitting, and when the reinforcing member is at the rear side position, said clearance is closed up to prevent the lock arm from flexing and in turn disables undoing of the fitting between the lock pawl and the fitting part.

3. The housing assembly as recited in claim 1, wherein the reinforcing member is provided with a protrusion that will contact the lock arm when the lock arm interferes with the reinforcing member.

4. The housing assembly as recited in claim 2, wherein the reinforcing member is provided with a protrusion that will contact the lock arm when the lock arm interferes with the reinforcing member.

5. The housing assembly as recited in claim 1, wherein the reinforcing member is provided, at locations laterally outwardly in the width direction from the fitting arms, with a pair of flexible holding arms extending substantially parallel to each other, from the body rearward in the depth direction, on a same common plane as said fitting arms, said common plane extending in said width direction and normal to said height direction, and each holding arm is provided with a hook part, which protrudes in the width direction to be caught on the first housing to prevent the reinforcing member from dropping forward in the depth direction.

6. The housing assembly as recited in claim 2, wherein the reinforcing member is provided, at locations laterally outwardly in the width direction from the fitting arms, with a pair of flexible holding arms extending substantially parallel to each other, from the body rearward in the depth direction, on a same common plane as said fitting arms, said common plane extending in said width direction and normal to said height direction, and each holding arm is provided with a hook part, which protrudes in the width direction to be caught on the first housing to prevent the reinforcing member from dropping forward in the depth direction.

7. The housing assembly as recited in claim 3, wherein the reinforcing member is provided, at locations laterally outwardly in the width direction from the fitting arms, with a pair of flexible holding arms extending substantially parallel to each other, from the body rearward in the depth direction, on a same common plane as said fitting arms, said common plane extending in said width direction and normal to said height direction, and each holding arm is provided with a hook part, which protrudes in the width direction to be caught on the first housing to prevent the reinforcing member from dropping forward in the depth direction.

8. The housing assembly as recited in claim 4, wherein the reinforcing member is provided, at locations laterally outwardly in the width direction from the fitting arms, with a pair of flexible holding arms extending substantially parallel to each other, from the body rearward in the depth direction, on a same common plane as said fitting arms, said common plane extending in said width direction and normal to said height direction, and each holding arm is provided with a hook part, which protrudes in the width direction to be caught on the first housing to prevent the reinforcing member from dropping forward in the depth direction.

9. The housing assembly as recited in claim 1, wherein the first housing or the second housing is provided with a contact.

10. The housing assembly as recited in claim 2, wherein the first housing or the second housing is provided with a contact.

11. The housing assembly as recited in claim 3, wherein the first housing or the second housing is provided with a contact.

12. The housing assembly as recited in claim 5, wherein the first housing or the second housing is provided with a contact.

13. A pair of electric connectors comprising the housing assembly of claim 1, a first contact provided in the first housing, and a second contact provided in the second housing, said pair of electric connectors being so structured that when the first housing is fitted in the second housing, the first contact will contact the second contact, and when the first housing is pulled out of the second housing, the first contact will be separated from the second contact.

14. A pair of electric connectors comprising the housing assembly of claim 2, a first contact provided in the first housing, and a second contact provided in the second housing, said pair of electric connectors being so structured that when the first housing is fitted in the second housing, the first contact will contact the second contact, and when the first housing is pulled out of the second housing, the first contact will be separated from the second contact.

15. A pair of electric connectors comprising the housing assembly of claim 3, a first contact provided in the first housing, and a second contact provided in the second housing, said pair of electric connectors being so structured that when the first housing is fitted in the second housing, the first contact will contact the second contact, and when the first housing is pulled out of the second housing, the first contact will be separated from the second contact.

16. A pair of electric connectors comprising the housing assembly of claim 5, a first contact provided in the first housing, and a second contact provided in the second housing, said pair of electric connectors being so structured that when the first housing is fitted in the second housing, the first contact will contact the second contact, and when the first housing is pulled out of the second housing, the first contact will be separated from the second contact.

* * * * *